US011077324B2

(12) United States Patent
Barbeau

(10) Patent No.: US 11,077,324 B2
(45) Date of Patent: Aug. 3, 2021

(54) HEM ASSEMBLY WITH ENHANCED ABRASION RESISTANCE

(71) Applicant: INNOTEX INC., Richmond (CA)

(72) Inventor: Claude Barbeau, St-Bruno (CA)

(73) Assignee: INNOTEX INC.

( * ) Notice: Subject to any disclaimer, the term of this patent is extended or adjusted under 35 U.S.C. 154(b) by 259 days.

(21) Appl. No.: 15/439,590

(22) Filed: Feb. 22, 2017

(65) Prior Publication Data

US 2017/0239499 A1 Aug. 24, 2017

Related U.S. Application Data

(60) Provisional application No. 62/298,119, filed on Feb. 22, 2016.

(51) Int. Cl.

| | |
|---|---|
| ***A41D 3/00*** | (2006.01) |
| ***A41D 27/24*** | (2006.01) |
| ***A62B 17/00*** | (2006.01) |
| ***A41D 27/10*** | (2006.01) |
| ***A41D 27/14*** | (2006.01) |
| ***A41D 1/06*** | (2006.01) |
| *A41D 31/08* | (2019.01) |

(52) U.S. Cl.

CPC ..... *A62B 17/003* (2013.01); *A41D 1/06* (2013.01); *A41D 3/00* (2013.01); *A41D 27/10* (2013.01); *A41D 27/145* (2013.01); *A41D 27/24* (2013.01); *A41D 31/085* (2019.02); *A41D 2600/20* (2013.01)

(58) Field of Classification Search

CPC ..... A61B 17/003; A61B 17/001; A61B 17/00; A41D 3/00; A41D 27/10; A41D 27/24; A41D 1/06

USPC ..... 2/81, 16, 275; 112/419, 418, 417; 428/104

See application file for complete search history.

(56) References Cited

U.S. PATENT DOCUMENTS 1,963,174 A * 6/1934 Oathout ..... A41F 1/00 112/408
2,813,272 A * 11/1957 Hagan ..... A41D 13/0005 2/16
3,010,114 A * 11/1961 Lipschultz ..... B29C 66/1122 428/103
3,867,890 A * 2/1975 Hamilton ..... D05B 35/062 112/139
3,940,812 A * 3/1976 DiForti ..... A43B 9/00 112/418
4,095,543 A * 6/1978 Gassman ..... B68G 7/105 112/417
4,543,670 A 10/1985 Ehring
(Continued)

OTHER PUBLICATIONS

"Outwardly" Merriam-Webster. Web. Feb. 27, 2020. https://www.merriam-webster.com/dictionary/outwardly.*
"Inward" https://www.merriam-webster.com/dictionary/inward.*

*Primary Examiner* — Jillian K Pierorazio
(74) *Attorney, Agent, or Firm* — Dilworth IP, LLC

(57) ABSTRACT

A firefighter protective garment includes an external material and at least one abrasion resistant hem assembly. The external material has an inner surface and the at least one abrasion resistant hem assembly includes a strip of reinforcing material affixed along an edge of the firefighter protective garment to the inner surface of the external material by a fastener. The fastener is embedded within the external material.

23 Claims, 5 Drawing Sheets

(56) References Cited

U.S. PATENT DOCUMENTS

| | | | | | |
|---|---|---|---|---|---|
| 4,627,112 | A | * | 12/1986 | Grilliot | A62B 17/003 2/81 |
| 4,631,753 | A | | 12/1986 | Ehring | |
| 4,768,233 | A | | 9/1988 | Grilliot et al. | |
| 4,782,534 | A | | 11/1988 | Grilliot et al. | |
| 5,001,785 | A | * | 3/1991 | Heiman | A41D 13/1209 2/114 |
| 5,208,919 | A | * | 5/1993 | Fields | A41D 27/10 2/123 |
| 5,247,708 | A | * | 9/1993 | Freese, Jr. | A62B 17/001 2/227 |
| 5,538,781 | A | * | 7/1996 | Rao | D03D 15/00 139/420 A |
| 5,890,226 | A | * | 4/1999 | Snedeker | A41D 27/10 2/123 |
| 2006/0277650 | A1 | | 12/2006 | Waters et al. | |
| 2009/0320176 | A1 | * | 12/2009 | Curtis | A41D 31/0027 2/81 |

* cited by examiner

HEM ASSEMBLY WITH ENHANCED ABRASION RESISTANCE

This application claims benefit of U.S. Provisional Patent Application Ser. No. 62/298,119, filed 22 Feb. 2016 which application is incorporated herein by reference. To the extent appropriate, a claim of priority is made to the above disclosed application.

TECHNICAL FIELD

This invention relates to the design and construction of hem assemblies. More particularly, the present invention is concerned with the construction of such a hem assembly with enhanced abrasion resistance to reduce the frequency of repairs to firefighter protective garments.

BACKGROUND

Firefighting activities involve many situations where the hems of firefighter's garment are exposed to mechanical forces that damage the garment and necessitate repair thereof.

Firefighter protective garments cuffs and hems are typically reinforced by folding over reinforcing strips and sewing them to the outer shell of the firefighter protective garment. When the reinforcing strips are made of a woven fabric, they do not provide sufficient resistance to mechanical forces and need to be repaired on a regular basis.

Firefighter garment manufacturers sometimes use strips of rough-out leather for the cuffs and hems. These leather reinforcing strips provide superior abrasion (i.e. mechanical) resistance and have the added benefit that the stitching joining them to the hems may be embedded in the leather, which provide at least partial protection against abrasion by reducing their exposure to the external environment.

However, leather absorbs biological and chemical contaminants encountered during the execution of firefighter duties. Moreover, it is not possible to thoroughly and effectively decontaminate the leather cuffs or hems without impairing their physical properties. Since these contaminants are a potential hazard to the health and safety not only of the firefighter who wore the garment, but also to anyone who might come into contact with the garment, the use of leather as a reinforcing cuff or hem on firefighter garments has fallen out of favor.

Firefighter protective garment manufacturers sometimes use impermeable, chemical-resistant and heat-resistant reinforcing materials. These materials are typically made of a woven substrate made of heat-resistant fibers coated with a polymeric material such as Hypalon. One example is a commercial product comprising para-aramid synthetic fiber and bearing the trade name Ara-shield®. The stitching that affixes the reinforcing materials to the firefighter garment are provided on the surface of the reinforcing material and are fragile. As a result, they need to be repaired on a regular basis.

Thus, it would be particularly useful to be able to provide an improved firefighter protective coat which, by virtue of its design and components, would be able to overcome or at least minimize some of the known drawbacks associated with conventional firefighter protective coats.

SUMMARY

In accordance with one aspect, there is provided a firefighter protective garment. The firefighter protective garment includes an external material and at least one abrasion resistant hem assembly. The external material has an inner surface, and the at least one abrasion resistant hem assembly includes a strip of reinforcing material affixed along an edge of the firefighter protective garment to the inner surface of the external material by a fastener. The fastener is embedded within the external material.

In one embodiment, the external material has a folded portion folded towards the inner surface of the external material along the edge, and the strip of reinforcing material is affixed to said folded portion.

In one embodiment, the strip of reinforcing material is longitudinally folded, thereby providing a thicker portion to the hem assembly, and the fastener is embedded within the thicker portion of the hem assembly.

In one embodiment, the strip of reinforcing material defines a channeled cuff portion projecting beyond said edge, and the hem assembly further comprises a reinforcing cord inserted in the channeled cuff portion.

In one embodiment, the reinforcing cord has a thickness selected to round an external edge of the folded strip of reinforcing material.

In one embodiment, the fastener comprises at least one row of stitching.

In one embodiment, the fastener comprises at least two rows of stitching spaced by a distance.

In one embodiment, the strip of reinforcing material is selected from the group including impermeable materials, chemical-resistant materials, heat-resistant materials and abrasion-resistant materials.

In one embodiment, the strip of reinforcing material comprises para-aramid synthetic fiber.

In one embodiment, the outer material defines an outer shell of a firefighter coat.

In one embodiment, the edge of the firefighter protective garment to which is affixed the hem assembly is one of a sleeve end and a waist bottom part.

In one embodiment, the at least one hem assembly comprises a pair of hem assemblies. The pair of hem assemblies is affixed to respective sleeve ends of the firefighter coat which define the corresponding edge of the firefighter protective garment.

In one embodiment, the sleeve ends each comprises a sleeve well, wherein the strip of reinforcing material is affixed between the external material and the sleeve well by the fastener, and wherein the fastener is embedded within both the external material and the sleeve well.

In one embodiment, the outer material defines an outer shell of a pair of firefighter pants.

In one embodiment, the at least one hem assembly comprises a pair of hem assemblies. The pair of hem assemblies is affixed to respective pant leg ends of the firefighter pants which define the corresponding edge of the firefighter protective garment.

In accordance with another aspect, there is provided a hem assembly with enhanced abrasion resistance comprising a reinforcing material; and an external material having an inner surface; wherein the reinforcing material is affixed to the inner surface of the external material by a fastener, the fastener being embedded within the external material and thereby providing resistance to abrasion.

In one embodiment, the external material is folded toward the inner surface and the reinforcing material is also folded, thereby providing a thicker portion to the hem assembly, the thicker portion having a length, and the fastener is embedded within the thicker portion of the hem assembly. According to another aspect of the present invention, there is provided hem assembly with enhanced abrasion resistance comprising:

a reinforcing material folded and forming a channeled cuff portion; and a reinforcing cord inserted, in the channeled cuff portion wherein the reinforcing cord rounds an external edge of the folded reinforcing material thereby protecting the edge of the folded reinforcing material from abrasion by eliminating creases that make some reinforcing materials prone to abrasion when assembled as hem assemblies, specifically at the cuffs.

In one embodiment, the hem assembly further includes an external material having an inner surface, wherein the reinforcing material is affixed to the inner surface of the external material by a fastener, the fastener being embedded within the external material and thereby providing resistance to abrasion.

In another implementation, the hem assembly further comprises an internal material having an outer surface, wherein the reinforcing material is affixed in between the external material and the internal material by the fastener, and wherein the fastener is embedded within both the external material and the internal material.

In one embodiment, the hem assembly further comprises an internal material having an outer surface, and the reinforcing material is affixed in between the external material and the internal material by the fastener;

the external material is folded toward the inner surface, the reinforcing material is also folded and the internal material is folded toward the outer surface of the internal material, thereby providing a thicker portion to the hem assembly, the thicker portion having a length;

the fastener is embedded within the thicker portion of the hem assembly; and the fastener is embedded within both the external material and the internal material.

In one embodiment, the fastener comprises at least one row of stitching.

In yet another implementation, the fastener comprises at least two rows of stitching spaced by a distance.

In one embodiment, the distance between the two rows of stitching is smaller than the length of the thicker portion, and the at least two rows of stitching are embedded within the thicker portion.

In one embodiment, the reinforcing material is selected from the group comprising impermeable materials, chemical-resistant materials, heat-resistant materials and abrasion-resistant materials.

In one embodiment, the reinforcing material comprises para-aramid synthetic fiber.

According to another aspect, there is provided the use of the hem assembly described herein for manufacturing of a firefighter garment, the firefighter garment comprising sleeve ends, pant leg ends and a waist bottom part, wherein the hem assembly is provided at each of the sleeves ends, the pant leg ends and the waist bottom part;

the external material is an outer shell material; the internal material is a combination of a moisture liner adjacent to the outer shell material, and a thermal liner adjacent to a firefighter's body; and the fastener of the hem assembly is embedded within the outer shell material on an external surface thereof, and within the thermal liner on a side closest to the firefighter's body.

In one embodiment, the outer shell material provides protection against at least one of puncture, cuts, abrasion and heat; the moisture barrier provides resistance to penetration of liquids or blood-borne pathogens while facilitating the transmission of metabolic heat away from the firefighter's body; and the thermal barrier provides resistance to heat from an external environment.

In one embodiment, the internal material of the sleeve ends also comprise s a sleeve well material providing protection against liquid ingress, and the fastener of the hem assembly is embedded within the outer shell material on the external surface thereof and within the sleeve well material on a side of the sleeve well material closest to the firefighter's body.

In one embodiment, the hem assembly provides resistance to abrasion to the fastener of the reinforcing material.

In one embodiment, the hem assembly reduces the frequency of repair to the fastener of the reinforcing material.

The objects, advantages and features of the present invention will become more apparent upon reading the following non-restrictive description of a preferred embodiment thereof, given for the purpose of exemplification only, with reference to the appended drawings.

DETAILED DESCRIPTION

In the following description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present invention illustrated in other figures can be easily inferred therefrom. The embodiments, geometrical configurations, materials mentioned and/or dimensions shown in the figures are optional, and are given for exemplification purposes only.

Furthermore, although the present invention may be used with various objects, such as firefighter garments, for example, it is understood that it may be used with other types of garments or articles of clothing. For this reason, expressions such as "garments", "firefighter", etc. as used herein should not be taken as to limit the scope of the present invention to these garments in particular. These expressions encompass all other kinds of materials, objects and/or purposes with which the present invention could be used and may be useful, as can be easily understood.

A firefighter protective garment is usually a coat or a pair of pants that may have one or more functional layer(s) of fire-resistant materials. The following layers are examples of functional layers:

1. An outer layer, which may provide protection against puncture, cuts, abrasion, and heat;
2. A moisture barrier, which may consist of a woven or non-woven substrate to which a fire resistant semi-permeable polymer is coated or laminated and which may provide resistance to penetration by liquids and blood-borne pathogens, while facilitating the transmission of metabolic heat away from the body of the firefighter and
3. A thermal barrier, which may comprise an insulating layer of batting or non-woven fabric quilted or laminated to a woven face cloth and which may provide the bulk of the resistance to the transmission of heat from the external environment to the body of the firefighter.

Figure 1A:
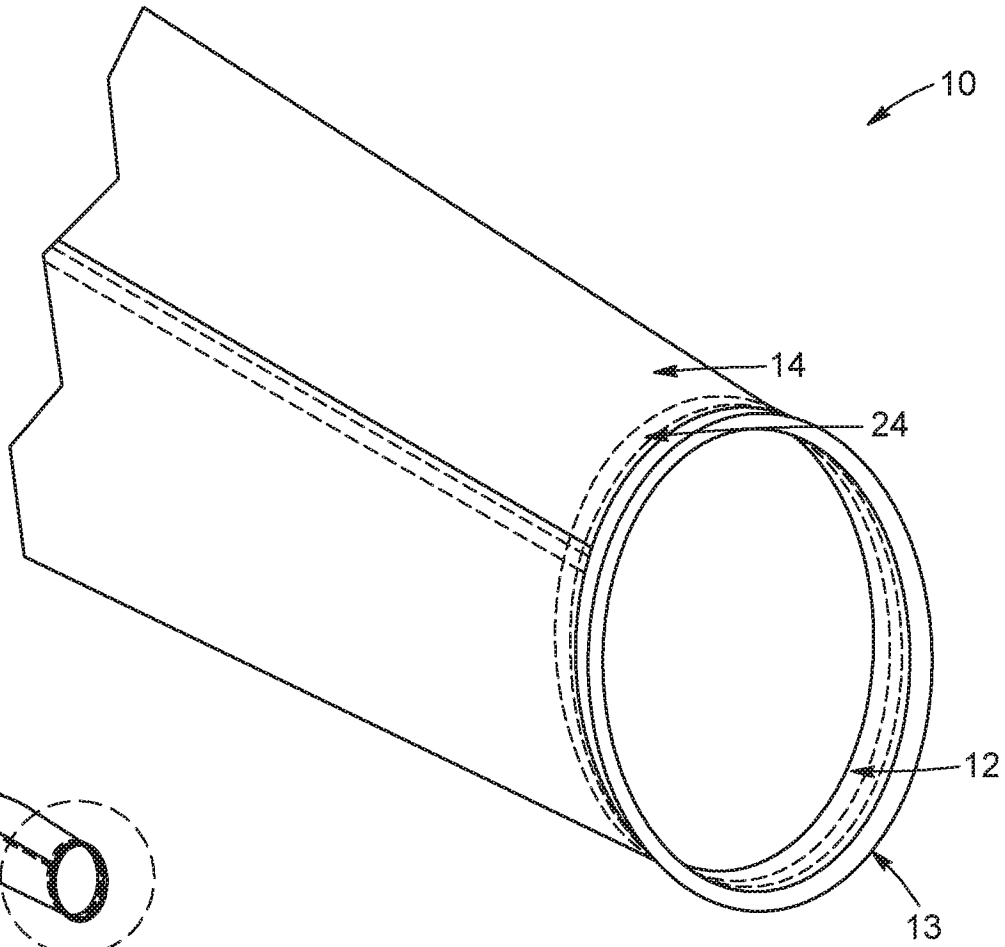
FIGS. 1 and 1A are a representation of a front view of a firefighter protective garment and a perspective view of a hem assembly, respectively, according to an embodiment of the invention.
Figure 1:
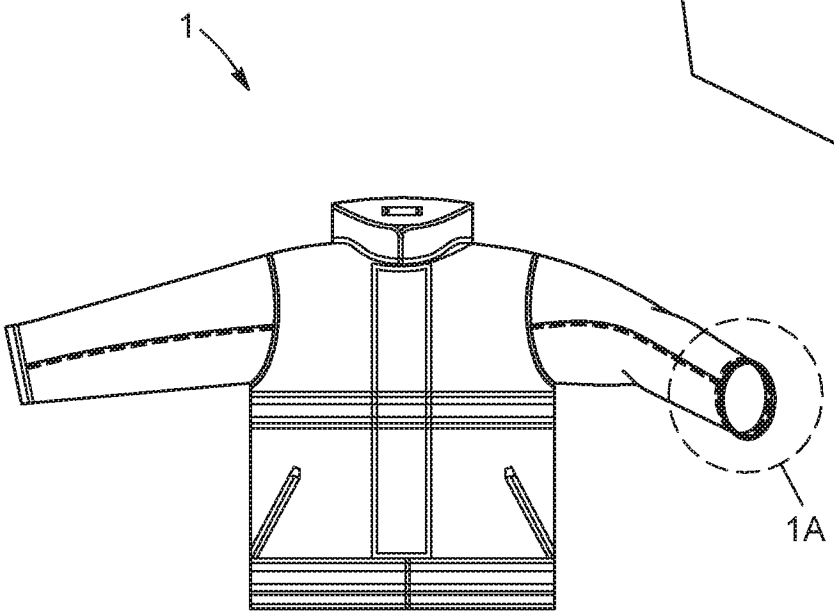
Figures 2, 2A:
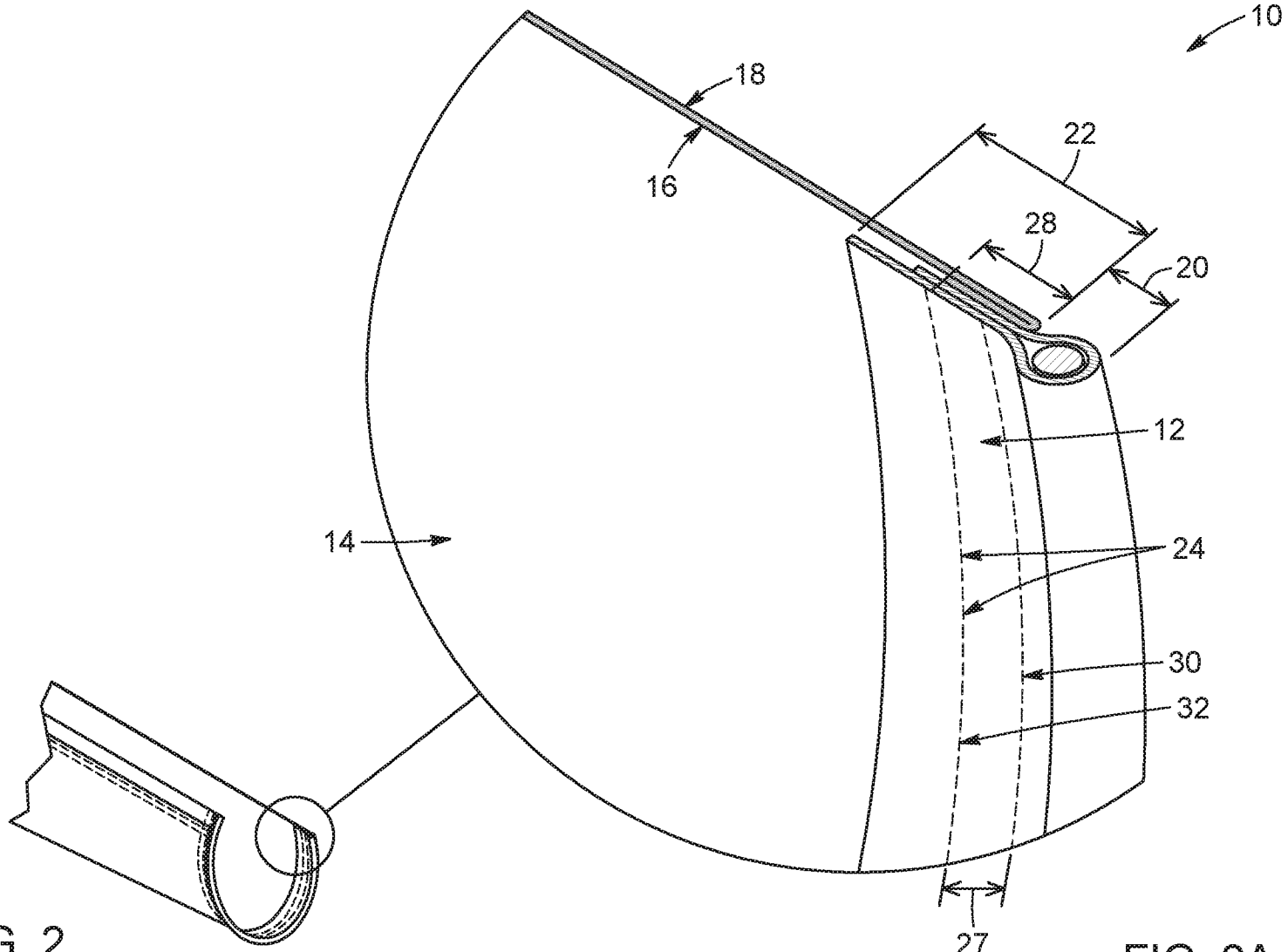
FIGS. 2 and 2A are a representation of a perspective view of a hem assembly, according to an embodiment of the invention.
Figure 3:
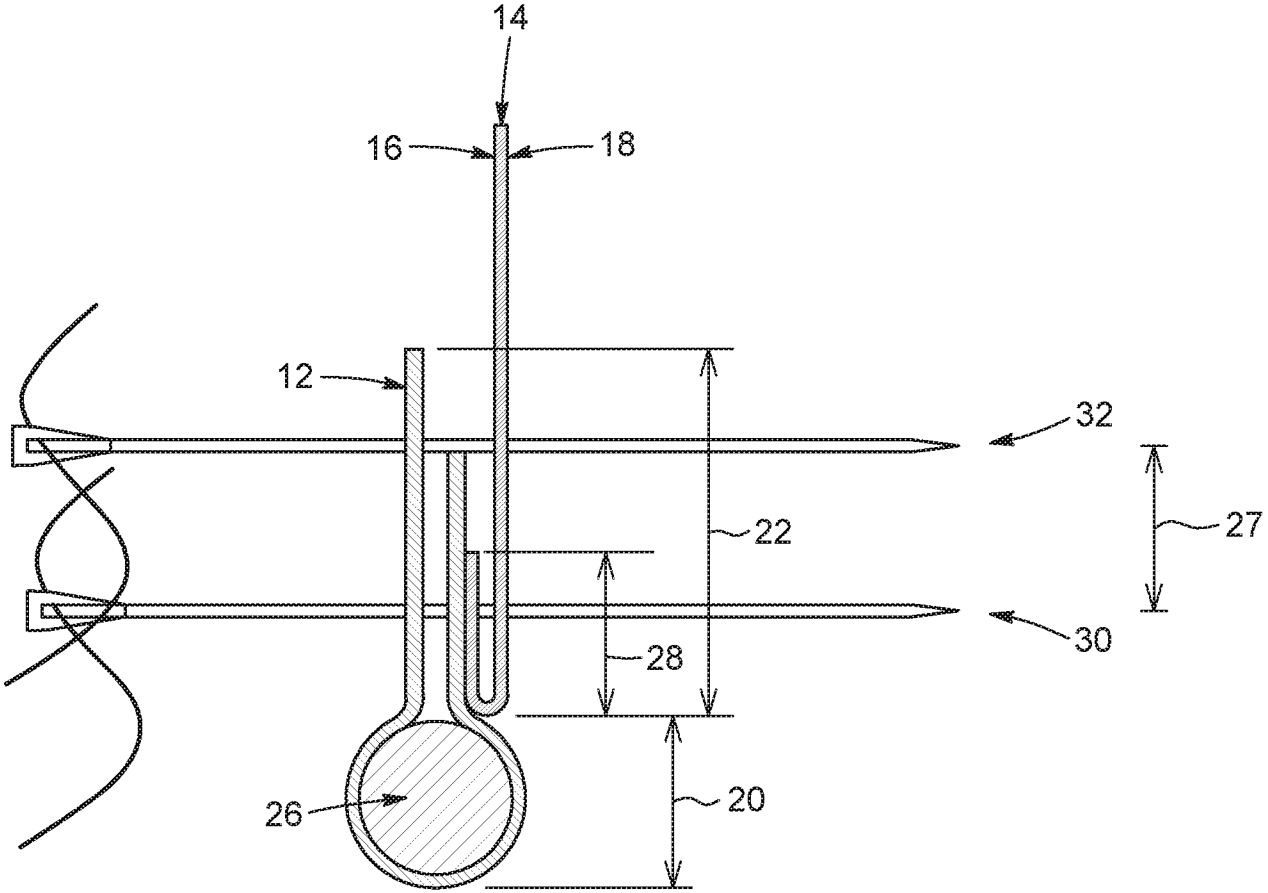
FIG. 3 is a representation of a cross section of a hem assembly, according to an embodiment of the invention.

As shown in FIGS. 1 to 3, there is provided a firefighter protective garment with enhanced resistance to abrasion. The firefighter protective garment includes an external material 14 and at least one abrasion resistant hem assembly 10. The external material 14 has an inner surface 16, and the at least one abrasion resistant hem assembly 10 includes a strip of reinforcing material 12 affixed along an edge 13 (i.e. an extremity) of the firefighter protective garment to the inner surface 16 of the external material by a fastener 24. The fastener 24 is embedded within the external material. In the following, the at least one abrasion resistant hem assembly 10 will be referred to as the hem assembly 10, so the two expressions should be understood as synonymous. The strip of reinforcing material 12 will be referred to as the reinforcing material 12. It will be understood that the hem assembly 10 may also be used with other types of garments, such as construction clothing or outdoor activities clothing, as known by a person skilled in the art.

The firefighter protective garment 1 comprises a reinforcing material 12 provided to protect the garment edge(s) 13 from numerous potential damages. In some embodiments, the reinforcing material 12 is an impermeable material with chemical resistance protecting from chemical or biological ingress. The reinforcing material 12 can also be a heat-resistance and abrasion-resistance material, thereby providing protection against thermal and mechanical attack. The reinforcing material 12 can be made of woven heat resistance fibers and coated with a polymeric material. Hypalon is an example of polymeric material used in the coating of the reinforcing material 12. In further embodiments, the reinforcing material 12 comprises para-aramid synthetic fiber, such as the Ara-shield® material for example. The reinforcing material 12 can be any resistant material known by the person skilled in the art.

The external material 14 has an inner surface 16 facing the interior (i.e. an inside portion) of the garment and an outer surface 18 facing the exterior (i.e. an outside portion). In some embodiments, the external material 14 can form an outer shell of material of a firefighter garment and provides protection against mechanical attacks such as puncture, cuts, abrasion and heat.

In some embodiments, the firefighter protective garment 1 may also comprise an internal material (not shown). The internal material may be, for example, a moisture barrier, a thermal barrier, a sleeve well or a combination thereof, and may be used in the firefighter garment 1 to provide resistance to liquid and/or blood-borne pathogens penetration, control metabolic heat transfer from the body to the external environment and/or provide resistance to heat transfer from the external environment. The internal material typically has two surfaces, a first one of the two surfaces facing the firefighter's body, and a second one of the two surfaces facing the external material 14 (i.e. the inner surface 16 of the external material 14).

In some embodiment, the external material 14 and the internal material extend over the entire surface of the firefighter protective garment 1. However, the person skilled in the art would understand that the hem assembly 10 may located on the end parts (i.e. the edge(s) 13) of the firefighter protective garment 1, and that the configuration of the different materials described herein relates to such end parts.

In some embodiments, the reinforcing material 12 may be affixed to the inner surface 16 of the external material 14. A protruding protecting part 20 of the reinforcing material 12 may protrude from the hem assembly 10 (and/or the edges 13 of the firefighter protective garment 1), and a fastening part 22 of the reinforcing material 12 is protected from the external environment by the external material 14, as the fastening part 22 is located in a portion of the firefighter protective garment which is not or minimally exposed to the external environment. The reinforcing material 12 may be affixed to the inner surface 16 of the external material 14 by a fastener 24. The fastener 24 may further be embedded within the external material 14. Optionally, the external material 14 is softer than the reinforcing material 12, and is thereby protected from any abrasion from the external environment.

In some embodiments, the fastener 24 comprises a row of stitching that is safely embedded and protected in the external material 14. In one implementation, the fastener 24 comprises two or more rows of stitching.

In some embodiments, the external material 14 has a folded portion folded toward the inner surface 16 along the edge 13. In the following, the folded portion folded toward the inner surface 16 will be referred to as a "folded portion" or a "portion folded".

For example, when folded, the folded portion forms a double layer of external material 14. It will be understood that the folded portion could be further folded.

In some embodiment, the reinforcing material 12 may be longitudinally folded, hence forming a thicker portion 28 as it includes two contiguous layers of material. For example, the fastener 24 may be embodied by one or more rows 30, 32 of stitching and may be fully embedded within the external material 14 of the thicker portion 28 so that no mechanical damage can be done to the fastener 24.

In some embodiments, the first row of stitching 30 may be used to affix the two layers of the reinforcing material 12 (i.e. the folded portion of the reinforcing material 12) with the two layers of the external material 14 (i.e. the folded portion of the external material 14). The second row of stitching 32 may be used to affix one of the two layers of the reinforcing material 12 (i.e. the folded portion of the reinforcing material 12) with one of the two layers of the external material 14 (i.e. the folded portion of the external material 14).

In some embodiment, the reinforcing material 12, when folded, may form a channeled cuff portion in the protruding protecting part 20 that may further enclose a reinforcing cord 26. The channeled cuff portion may project beyond the edge 13. The reinforcing cord 26 in the channeled cuff portion rounds an external edge of the folded reinforcing material thereby protecting the edge of the folded reinforcing material from abrasion, as opposed to a straight edge. The rounded edge provides a greater contact surface of the folded material against abrasive contacts and hence decreases the concentration of damaging frictional contact. The reinforcing cord may be useful, for example, for eliminating some creases typically present near the edges 13 of the firefighter protective garment 1. Therefore, the presence of the reinforcing cord 26 further enhances the abrasion resistance of the hem assembly 10, and the mechanical resistance of the garment ends.

In some embodiment, the reinforcing cord 26 has a thickness selected to round an external edge of the folded strip of reinforcing material. The thickness (corresponding to a diameter, if the reinforcing cord 26 has a substantially circular cross-section) may be comprised between 0.3 and 1 cm, and may be, for example, around 0.6 cm.

The fastening part 22 of the reinforcing material 12 can have a variety of lengths. In some embodiments, the fastener 24 comprises two rows of stitching spaced by a distance 27. The fastening part 22 should be longer than the distance 27.

In some embodiments, and as shown in FIG. 3, the fastener 24 comprises a first row of stitching 30 close to the protruding protecting part 20 and a second row of stitching 32 further in the fastening part 22. The external material 14 and the reinforcing material 12 can be folded in such a manner that the first row of stitching 30 crosses four layers of material (two layers of external material 14 and two layers of reinforcing material 12) and the second row of stitching 32 crosses two layers (one layer of external material 14 and one layer of reinforcing material 12. In a further embodiment, the hem assembly 10 also comprises the internal material, therefore the first row of stitching 30 crosses five layers of material if the internal material is a single layer, and more than five layers of material if the internal material is folded.

It is understood by the person skilled in the art that many other configurations can be considered with regard to the number of stitching rows, the number of folded layers, or the nature and location of the fastener.

Figures 4, 4A, 4B:
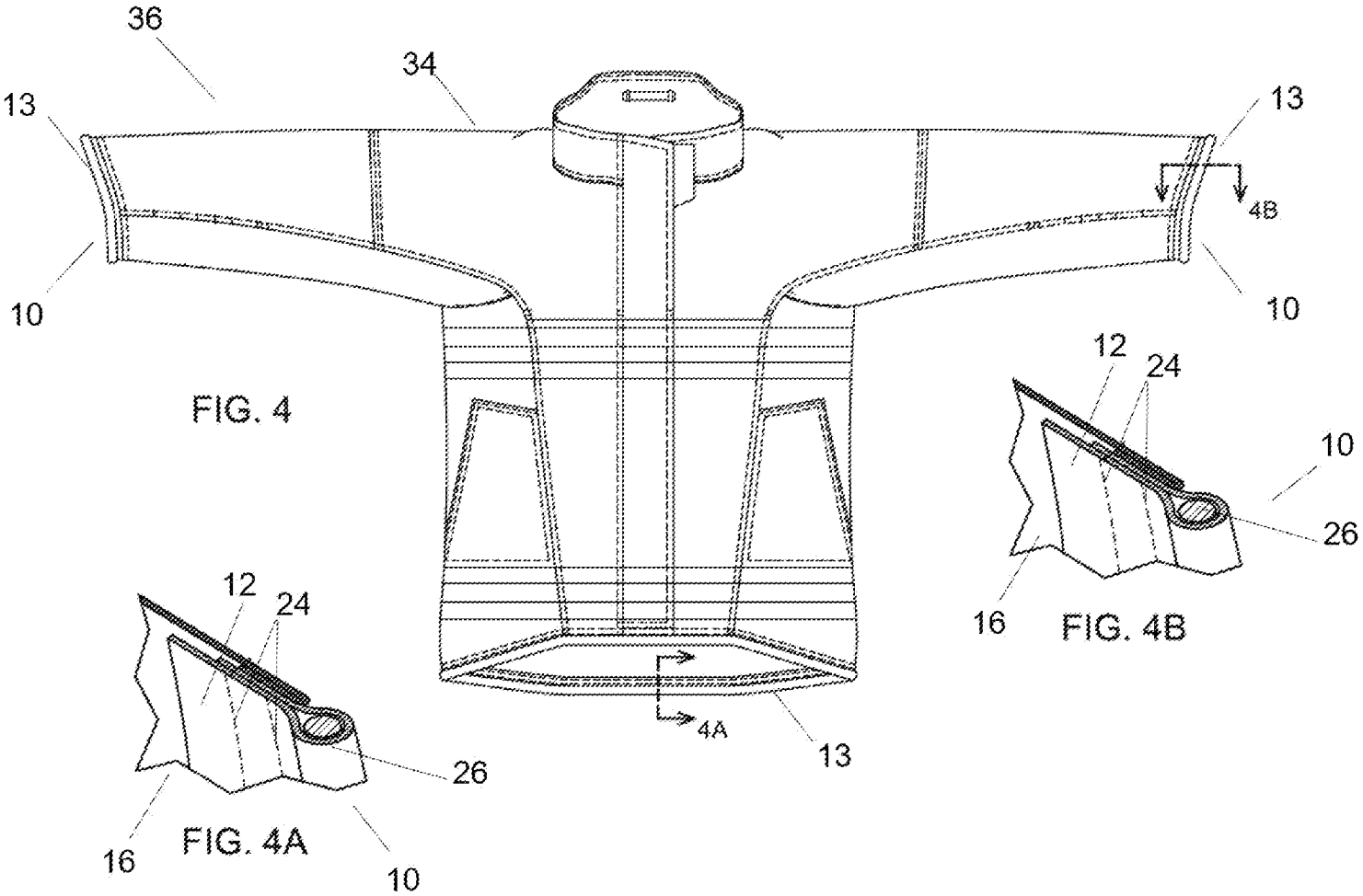
FIGS. 4, 4A, and 4B are a representation of a front view of a firefighter coat, a perspective view of a first hem assembly, and a perspective view of a second hem assembly, respectively, according to an embodiment of the invention.

In one implementation, such as the one depicted in FIGS. 4, 4A and 4B, the external material defines an outer shell 34 of a firefighter coat 36. For example, the edge 13 of the firefighter protective garment to which is affixed the hem assembly may be one of a sleeve end (also referred to as "sleeve cuff" or "cuff") and a waist bottom part.

In some embodiments, the hem assembly 10 may comprise a pair of hem assemblies affixed to respective sleeve ends of the firefighter coat which define the corresponding edge 13 of the firefighter protective garment 1.

In some embodiments, each of the sleeve ends may comprise a sleeve well and the strip of reinforcing material 12 may be affixed between the external material 14 and the sleeve well by the fastener. The fastener may be embedded within both the external material and the sleeve well.

Figure 5A:
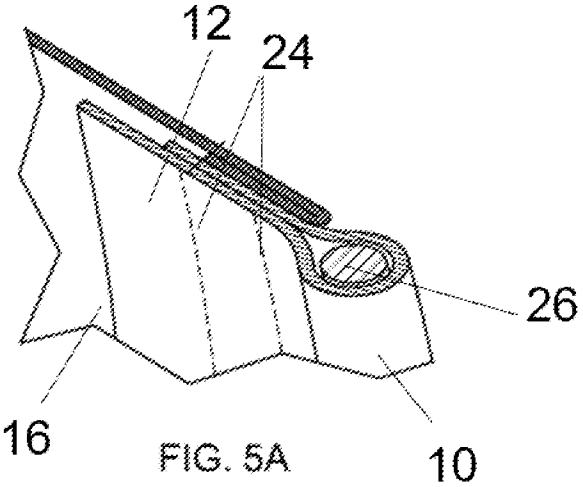
FIGS. 5 and 5A are a representation of a front view of firefighter pants and a perspective view of a hem assembly, respectively, according to an embodiment of the invention.
Figure 5:
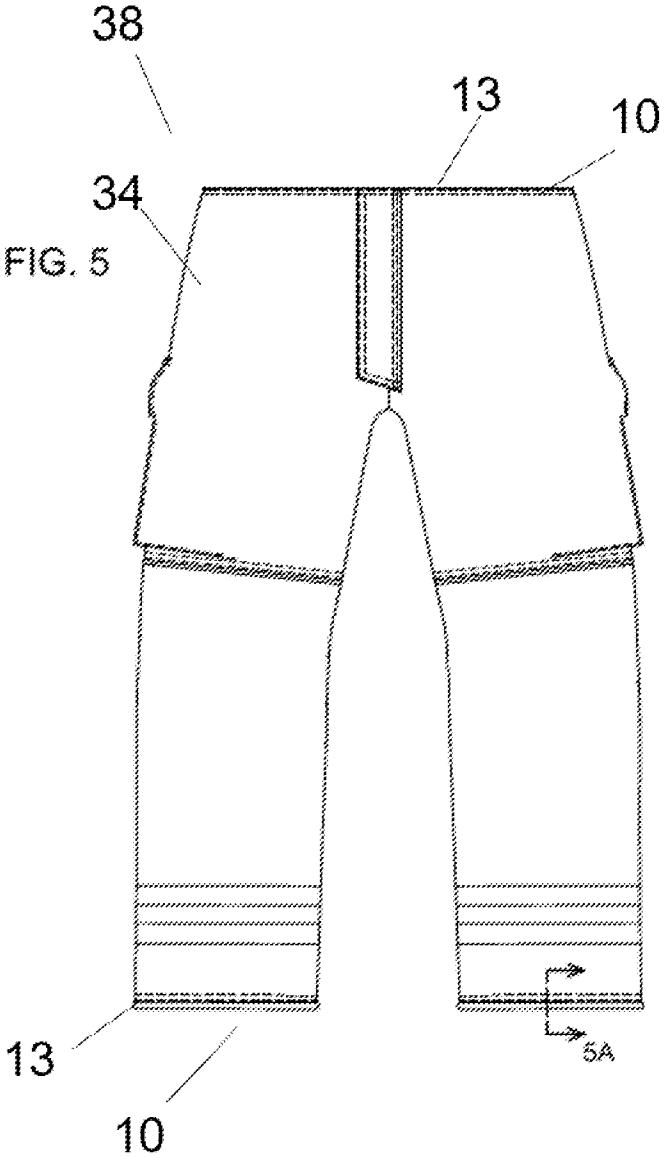

In one implementation, such as the one depicted in FIGS. 5 and 5A, the external material 14 is an outer shell 34 of a pair of firefighter pants 38.

In some embodiments, the hem assembly 10 may comprise a pair of hem assemblies affixed to respective pant leg ends of the firefighter pants which define the corresponding edge(s) 13 of the firefighter protective garment 1.

There is also provided a use of the hem assembly 10 as described herein for manufacturing of a firefighter garment.

In one embodiment, the hem assembly 10 described herein is provided for manufacturing of a firefighter garment comprising sleeves ends and a waist bottom part on an upper half corresponding to a firefighter coat, and pant leg ends on a bottom half corresponding to firefighter pants. The firefighter garment can also be a one-piece garment, or have any other configuration known by the person skilled in the art.

In the preferred embodiment, each of the sleeves ends, the waist bottom part and each of the pant leg ends are provided with the hem assembly 10.

In some embodiments, the hem assembly 10 is provided for manufacturing of a firefighter garment comprising both external material 14 and internal material. The external material 14 is an outer shell material, and the internal material is a combination of a moisture liner and a thermal liner. The thermal liner is adjacent to the firefighter's body and the moisture liner is adjacent to the outer shell material. The reinforcing material 12 is affixed between the outer shell material and the moisture liner. The fastener 24 is embedded within the outer shell material on an external surface that faces the exterior, and within the thermal liner on a side closest to the firefighter's body.

In a further embodiment, the hem assembly 10 is provided for manufacturing of a firefighter garment comprising an internal material having sleeve well material. Sleeve well material is provided to the internal material of the sleeve ends to ensure protection against liquid ingress. In this configuration, the fastener 24 is embedded within the outer shell material on the external surface that faces the exterior, and within the sleeve well material on a side closest to the firefighter's body.

The hem assembly 10 described herein may be useful for providing abrasion resistance to the firefighter garment 1. Furthermore, the fastener 24 affixing the reinforcing material 12 to the edges 13 of the firefighter garment 1 is also protected from abrasion, as the fastener 24 is embedded within the external material 14. Therefore, the use of the hem assembly 10 also allows reducing the damages done to the fastener 24, and the frequency of repair of the hem assembly 10.

It will be readily understood by one skilled in the art that the above-mentioned embodiments are merely illustrative of the possible specific embodiments which may represent principles of the present invention. Of course, numerous modifications could be made to the embodiment described above without departing from the scope of the present invention as defined in the appended claims.

The invention claimed is:

1. A firefighter protective garment, comprising:

an external material having an inner surface; and at least one abrasion resistant hem assembly comprising:

a strip of reinforcing material positioned along an edge of the firefighter protective garment inwardly of the external material, the strip of reinforcing material having abrasion-resistance properties providing protection against mechanical forces encountered during firefighting activities, the strip of reinforcing material comprising:

a first end portion affixed to the inner surface of the external material by a fastener, the fastener being embedded within the external material;

a second end portion affixed to the first end portion, the first end portion being sandwiched between the inner surface of the external material and the second end portion; and a channeled cuff portion extending outwardly from the edge of the firefighter protective garment, the channeled cuff portion being formed by longitudinally folding the strip of reinforcing material and joining the second end portion with the first end portion; and a reinforcing cord inserted in the channeled cuff portion, the reinforcing cord having a substantially circular cross-section configured to reduce a concentration of frictional contacts near the edge of the firefighter protective garment by rounding an external edge of the strip of reinforcing material.

2. The firefighter protective garment according to claim 1, wherein the hem assembly comprises a thicker portion, the fastener being embedded within the thicker portion of the hem assembly.

3. The firefighter protective garment according to claim 1, wherein the fastener comprises at least one row of stitching.

4. The firefighter protective garment according to claim 1, wherein the fastener comprises at least two rows of stitching spaced by a distance.

5. The firefighter protective garment according to claim 1, wherein the strip of reinforcing material is made of woven heat resistance fibers and coated with a polymeric material.

6. The firefighter protective garment according to claim 1, wherein the strip of reinforcing material comprises para-aramid synthetic fiber.

7. The firefighter protective garment of claim 1, wherein the first end portion directly contacts the inner surface of the external material.

8. A firefighter protective coat having a pair of sleeves, comprising:

an outer shell providing protection against mechanical attacks and heat, the outer shell having an inner surface; and a pair of abrasion resistant hem assemblies, each associated with a corresponding sleeve of said pair of sleeves, each abrasion resistant hem assembly comprising:

a reinforcing strip made of a material having abrasion-resistance properties providing protection against mechanical forces encountered during firefighting activities, the reinforcing strip being positioned inwardly of the outer shell along an edge of the corresponding sleeve, the reinforcing strip comprising;

a first end portion affixed to the inner surface of the outer shell by a fastener, the fastener comprising at least one row of stitching embedded within the outer shell;

a second end portion affixed to the first end portion, the first end portion being sandwiched between the inner surface of the outer shell and the second end portion; and a channeled cuff portion extending outwardly of the edge of the corresponding sleeve, the channeled cuff portion being formed by longitudinally folding the reinforcing strip and joining the second end portion with the first end portion; and a reinforcing cord extending in the channeled cuff portion, the reinforcing cord having a substantially circular cross-section configured to reduce a concentration of frictional contacts near the edge of the corresponding sleeve by rounding an external edge of the reinforcing strip.

9. The firefighter protective coat according to claim 8, wherein each abrasion resistant hem assembly comprises a thicker portion, the fastener being embedded within said thicker portion.

10. The firefighter protective coat according to claim 8, wherein the fastener comprises at least two rows of stitching spaced by a distance.

11. The firefighter protective coat according to claim 8, wherein the reinforcing strip is made of woven heat resistance fibers and coated with a polymeric material.

12. The firefighter protective coat according to claim 8, wherein the reinforcing strip comprises para-aramid synthetic fiber.

13. The firefighter protective coat according to claim 8, further comprising a third abrasion resistant hem assembly provided at a waist portion of the firefighter protective coat.

14. The firefighter protective coat according to claim 8, wherein each sleeve of said pair comprises a sleeve well, the reinforcing strip of the corresponding abrasion resistant hem assembly being affixed between the outer shell and the sleeve well by the fastener, and wherein the fastener is embedded within both the outer shell and the sleeve well.

15. The firefighter protective coat of claim 8, wherein the first end portion directly contacts the inner surface of the outer shell.

16. Firefighter protective pants having a pair of legs, comprising:

an outer shell providing protection against mechanical attacks and heat, the outer shell having an inner surface; and a pair of abrasion resistant hem assemblies, each associated with a corresponding leg of said pair of legs, each abrasion resistant hem assembly comprising:

a reinforcing strip made of a material having abrasion-resistance properties providing protection against mechanical forces encountered during firefighting activities, the reinforcing strip being positioned inwardly of the outer shell along an edge of the corresponding leg, the reinforcing strip comprising:

a first end portion affixed to the inner surface of the outer shell by a fastener, the fastener comprising at least one row of stitching embedded within the outer shell;

a second end portion affixed to the first end portion, the first end portion being sandwiched between the inner surface of the outer shell and the second end portion; and a channeled cuff portion extending outwardly of the edge of the corresponding leg, the channeled cuff portion being formed by longitudinally folding the reinforcing strip and joining the second end portion with the first end portion; and a reinforcing cord extending in the channeled cuff portion, the reinforcing cord having a substantially circular cross-section configured to reduce a concentration of frictional contacts near the edge of the corresponding leg by rounding an external edge of the reinforcing strip.

17. The firefighter protective pants according to claim 16, wherein each abrasion resistant hem assembly comprises a thicker portion thereof, the fastener being embedded within said thicker portion.

18. The firefighter protective pants according to claim 16, wherein the fastener comprises at least two rows of stitching spaced by a distance.

19. The firefighter protective pants according to claim 16, wherein the reinforcing strip is made of woven heat resistance fibers and coated with a polymeric material.

20. The firefighter protective pants according to claim 16, wherein the reinforcing strip comprises para-aramid synthetic fiber.

21. The firefighter protective pants according to claim 16, further comprising a third abrasion resistant hem assembly provided at a waist portion of the firefighter protective pants.

22. The firefighter protective pants according to claim 16, wherein each leg of said pair comprises a leg well, the reinforcing strip of the corresponding abrasion resistant hem assembly being affixed between the outer shell and the leg well by the fastener, and wherein the fastener is embedded within both the outer shell and the leg well.

23. The firefighter protective pants of claim 16, wherein the first end portion directly contacts the inner surface of the outer shell.

* * * * *